US007213656B2

(12) United States Patent
Pietras

(10) Patent No.: US 7,213,656 B2
(45) Date of Patent: May 8, 2007

(54) APPARATUS AND METHOD FOR FACILITATING THE CONNECTION OF TUBULARS USING A TOP DRIVE

(75) Inventor: Bernd-Georg Pietras, Wedemark (DE)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/831,864

(22) Filed: Apr. 26, 2004

(65) Prior Publication Data

US 2004/0194965 A1 Oct. 7, 2004

Related U.S. Application Data

(63) Continuation of application No. 09/868,790, filed as application No. PCT/GB99/03951 on Nov. 29, 1999, now Pat. No. 6,725,938.

(30) Foreign Application Priority Data

Dec. 24, 1998 (GB) ..... 9828673

(51) Int. Cl.
*E21B 19/16* (2006.01)

(52) U.S. Cl. ..... 166/380; 166/85.1

(58) Field of Classification Search ..... 166/77.51, 166/85.1, 78.1, 380; 175/162, 171
See application file for complete search history.

(56) References Cited

U.S. PATENT DOCUMENTS

| | | | |
|---|---|---|---|
| 122,514 | A | 1/1872 | Bullock |
| 179,973 | A | 7/1876 | Thornton |
| 1,077,772 | A | 11/1913 | Weathersby |
| 1,185,582 | A | 5/1916 | Bignell |
| 1,301,285 | A | 4/1919 | Leonard |
| 1,342,424 | A | 6/1920 | Cotten |
| 1,418,766 | A | 6/1922 | Wilson |
| 1,471,526 | A | 10/1923 | Pickin |
| 1,585,069 | A | 5/1926 | Youle |
| 1,728,136 | A | 9/1929 | Power |
| 1,777,592 | A | 10/1930 | Thomas |
| 1,805,007 | A | 5/1931 | Pedley |
| 1,825,028 | A | 9/1931 | Thomas |
| 1,830,625 | A | 11/1931 | Schrock |
| 1,842,638 | A | 1/1932 | Wigle |
| 1,880,218 | A | 10/1932 | Simmons |
| 1,917,135 | A | 7/1933 | Littell |
| 1,981,525 | A | 11/1934 | Price |

(Continued)

FOREIGN PATENT DOCUMENTS

CA 2 307 386 11/2000

(Continued)

OTHER PUBLICATIONS

LaFleur Petroleum Services, Inc., "Autoseal Circulating Head," Engineering Manufacturing, 1992, 11 Pages.

(Continued)

*Primary Examiner*—Jennifer H. Gay
*Assistant Examiner*—Daniel P Stephenson
(74) *Attorney, Agent, or Firm*—Patterson & Sheridan, L.L.P.

(57) ABSTRACT

An apparatus and method for facilitating the connection of tubulars using a top drive and is, more particularly but not exclusively, intended for facilitating the connection of a section or stand of casing to a string of casing.

58 Claims, 3 Drawing Sheets

U.S. PATENT DOCUMENTS

| | | | | |
|---|---|---|---|---|
| 1,998,833 | A | 4/1935 | Crowell | |
| 2,017,451 | A | 10/1935 | Wickersham | |
| 2,049,450 | A | 8/1936 | Johnson | |
| 2,060,352 | A | 11/1936 | Stokes | |
| 2,105,885 | A | 1/1938 | Hinderliter | |
| 2,128,430 | A | 8/1938 | Pryor | |
| 2,167,338 | A | 7/1939 | Murcell | 166/380 |
| 2,184,681 | A | 12/1939 | Osmun et al. | |
| 2,214,429 | A | 9/1940 | Miller | |
| 2,216,895 | A | 10/1940 | Stokes | |
| 2,228,503 | A | 1/1941 | Boyd et al. | |
| 2,295,803 | A | 9/1942 | O'Leary | |
| 2,305,062 | A | 12/1942 | Church et al. | |
| 2,324,679 | A | 7/1943 | Cox | |
| 2,370,832 | A | 3/1945 | Baker | |
| 2,379,800 | A | 7/1945 | Hare | |
| 2,414,719 | A | 1/1947 | Cloud | |
| 2,499,630 | A | 3/1950 | Clark | |
| 2,522,444 | A | 9/1950 | Grable | |
| 2,536,458 | A | 1/1951 | Munsinger | |
| 2,570,080 | A | 10/1951 | Stone | |
| 2,610,690 | A | 9/1952 | Beatty | |
| 2,621,742 | A | 12/1952 | Brown | |
| 2,627,691 | A | 2/1953 | Clark | |
| 2,641,444 | A | 6/1953 | Moon | |
| 2,650,314 | A | 8/1953 | Hennigh et al. | |
| 2,663,073 | A | 12/1953 | Bieber et al. | |
| 2,668,689 | A | 2/1954 | Cormany | |
| 2,692,059 | A | 10/1954 | Bolling, Jr. | |
| 2,720,267 | A | 10/1955 | Brown | |
| 2,738,011 | A | 3/1956 | Mabry | |
| 2,741,907 | A | 4/1956 | Genender et al. | |
| 2,743,087 | A | 4/1956 | Layne et al. | |
| 2,743,495 | A | 5/1956 | Eklund | |
| 2,764,329 | A | 9/1956 | Hampton | |
| 2,765,146 | A | 10/1956 | Williams | |
| 2,805,043 | A | 9/1957 | Williams | |
| 2,953,406 | A | 9/1960 | Young | |
| 2,965,177 | A | 12/1960 | Bus, Sr. et al. | |
| 2,978,047 | A | 4/1961 | DeVaan | |
| 3,006,415 | A | 10/1961 | Burns et al. | |
| 3,041,901 | A | 7/1962 | Knights | 81/53 |
| 3,054,100 | A | 9/1962 | Jones | |
| 3,087,546 | A | 4/1963 | Wooley | |
| 3,090,031 | A | 5/1963 | Lord | |
| 3,102,599 | A | 9/1963 | Hillburn | |
| 3,111,179 | A | 11/1963 | Albers et al. | |
| 3,117,636 | A | 1/1964 | Wilcox et al. | |
| 3,122,811 | A | 3/1964 | Gilreath | |
| 3,123,160 | A | 3/1964 | Kammerer | |
| 3,124,023 | A | 3/1964 | Marquis et al. | |
| 3,131,769 | A | 5/1964 | Rochemont | |
| 3,159,219 | A | 12/1964 | Scott | |
| 3,169,592 | A | 2/1965 | Kammerer | |
| 3,191,677 | A | 6/1965 | Kinley | |
| 3,191,680 | A | 6/1965 | Vincent | |
| 3,193,116 | A | 7/1965 | Kennedy et al. | 214/2.5 |
| 3,353,599 | A | 11/1967 | Swift | |
| 3,380,528 | A | 4/1968 | Timmons | 166/14 |
| 3,387,893 | A | 6/1968 | Hoever | |
| 3,392,609 | A | 7/1968 | Bartos | |
| 3,266,582 | A | 8/1968 | Homanick | |
| 3,419,079 | A | 12/1968 | Current | |
| 3,477,527 | A | 11/1969 | Koot | |
| 3,489,220 | A | 1/1970 | Kinley | |
| 3,518,903 | A | 7/1970 | Ham et al. | |
| 3,548,936 | A | 12/1970 | Kilgore et al. | |
| 3,550,684 | A | 12/1970 | Cubberty, Jr. | |
| 3,552,507 | A | 1/1971 | Brown | |
| 3,552,508 | A | 1/1971 | Brown | |
| 3,552,509 | A | 1/1971 | Brown | |
| 3,552,510 | A | 1/1971 | Brown | |
| 3,552,848 | A | 1/1971 | Van Wagner | |
| 3,559,739 | A | 2/1971 | Hutchison | |
| 3,566,505 | A | 3/1971 | Martin | 29/200 |
| 3,570,598 | A | 3/1971 | Johnson | 166/178 |
| 3,575,245 | A | 4/1971 | Cordary et al. | |
| 3,602,302 | A | 8/1971 | Kluth | |
| 3,603,411 | A | 9/1971 | Link | |
| 3,603,412 | A | 9/1971 | Kammerer, Jr. et al. | |
| 3,603,413 | A | 9/1971 | Grill et al. | |
| 3,606,664 | A | 9/1971 | Weiner | |
| 3,624,760 | A | 11/1971 | Bodine | |
| 3,635,105 | A | 1/1972 | Dickmann et al | 81/57.18 |
| 3,638,989 | A | 2/1972 | Sandquist | |
| 3,656,564 | A | 4/1972 | Brown | |
| 3,662,842 | A | 5/1972 | Bromell | |
| 3,669,190 | A | 6/1972 | Sizer et al. | |
| 3,680,412 | A | 8/1972 | Mayer et al. | |
| 3,691,624 | A | 9/1972 | Kinley | |
| 3,691,825 | A | 9/1972 | Dyer | 73/136 |
| 3,692,126 | A | 9/1972 | Rushing et al. | |
| 3,696,332 | A | 10/1972 | Dickson, Jr. et al. | |
| 3,700,048 | A | 10/1972 | Desmoulins | |
| 3,706,347 | A | 12/1972 | Brown | |
| 3,729,057 | A | 4/1973 | Wemer | |
| 3,746,330 | A | 7/1973 | Taciuk | |
| 3,747,675 | A | 7/1973 | Brown | 166/237 |
| 3,760,894 | A | 9/1973 | Pitifer | |
| 3,776,320 | A | 12/1973 | Brown | 173/163 |
| 3,776,991 | A | 12/1973 | Marcus | 264/89 |
| 3,780,883 | A | 12/1973 | Brown | |
| 3,785,193 | A | 1/1974 | Kinley et al. | |
| 3,808,916 | A | 5/1974 | Porter et al. | |
| 3,838,613 | A | 10/1974 | Wilms | |
| 3,840,128 | A | 10/1974 | Swoboda, Jr. et al. | |
| 3,848,684 | A | 11/1974 | West | 175/195 |
| 3,857,450 | A | 12/1974 | Guier | 175/85 |
| 3,870,114 | A | 3/1975 | Pulk, deceased et al. | |
| 3,871,618 | A | 3/1975 | Funk | |
| 3,881,375 | A | 5/1975 | Kelly | |
| 3,885,679 | A | 5/1975 | Swoboda, Jr. et al. | |
| 3,901,331 | A | 8/1975 | Djurovic | |
| 3,913,687 | A | 10/1975 | Gyongyosi et al. | 175/85 |
| 3,915,244 | A | 10/1975 | Brown, deceased | |
| 3,934,660 | A | 1/1976 | Nelson | |
| 3,945,444 | A | 3/1976 | Knudson | |
| 3,947,009 | A | 3/1976 | Nelmark | |
| 3,964,552 | A | 6/1976 | Slator | |
| 3,964,556 | A | 6/1976 | Gearhart et al. | |
| 3,980,143 | A | 9/1976 | Swartz et al. | |
| 4,049,066 | A | 9/1977 | Richey | |
| 4,054,332 | A | 10/1977 | Bryan, Jr. | |
| 4,054,426 | A | 10/1977 | White | |
| 4,064,939 | A | 12/1977 | Marquis | |
| 4,077,525 | A | 3/1978 | Callegari et al. | |
| 4,082,144 | A | 4/1978 | Marquis | |
| 4,083,405 | A | 4/1978 | Shirley | |
| 4,085,808 | A | 4/1978 | Kling | |
| 4,095,865 | A | 6/1978 | Denison et al. | |
| 4,100,968 | A | 7/1978 | Delano | 166/315 |
| 4,100,981 | A | 7/1978 | Chaffin | |
| 4,127,927 | A | 12/1978 | Hauk et al. | |
| 4,133,396 | A | 1/1979 | Tschirky | |
| 4,142,739 | A | 3/1979 | Billingsley | |
| 4,173,457 | A | 11/1979 | Smith | |
| 4,175,619 | A | 11/1979 | Davis | |
| 4,186,628 | A | 2/1980 | Bonnice | |
| 4,189,185 | A | 2/1980 | Kammerer, Jr. et al. | |
| 4,194,383 | A | 3/1980 | Huzyak | |
| 4,202,225 | A | 5/1980 | Sheldon et al. | |
| 4,221,269 | A | 9/1980 | Hudson | |
| 4,227,197 | A | 10/1980 | Nimmo et al. | |
| 4,241,878 | A | 12/1980 | Underwood | |

4,257,442 A 3/1981 Claycomb
4,262,693 A 4/1981 Giebeler
4,274,777 A 6/1981 Scaggs
4,274,778 A 6/1981 Putnam et al.
4,277,197 A 7/1981 Bingham
4,280,380 A 7/1981 Eshghy
4,281,722 A 8/1981 Tucker et al.
4,287,949 A 9/1981 Lindsey, Jr.
4,311,195 A 1/1982 Mullins, II
4,315,553 A 2/1982 Stallings
4,320,915 A 3/1982 Abbott et al. ..... 294/96
4,336,415 A 6/1982 Walling
4,384,627 A 5/1983 Ramirez-Jauregui
4,392,534 A 7/1983 Miida
4,396,076 A 8/1983 Inoue
4,396,077 A 8/1983 Radtke
4,407,378 A 10/1983 Thomas
4,408,669 A 10/1983 Wiredal
4,413,682 A 11/1983 Callihan et al.
4,427,063 A 1/1984 Skinner
4,437,363 A 3/1984 Haynes ..... 81/57.18
4,440,220 A 4/1984 McArthur
4,445,734 A 5/1984 Cunningham
4,446,745 A 5/1984 Stone et al.
4,449,596 A 5/1984 Boyadjieff ..... 175/85
4,460,053 A 7/1984 Jurgens et al.
4,463,814 A 8/1984 Horstmeyer et al.
4,466,498 A 8/1984 Bardwell
4,470,470 A 9/1984 Takano
4,472,002 A 9/1984 Beney et al.
4,474,243 A 10/1984 Gaines
4,483,399 A 11/1984 Colgate
4,489,793 A 12/1984 Boren
4,489,794 A 12/1984 Boyadjieff
4,492,134 A 1/1985 Reinholdt et al.
4,494,424 A 1/1985 Bates ..... 81/57.18
4,515,045 A 5/1985 Gnatchenko et al.
4,529,045 A 7/1985 Boyadjieff et al. ..... 173/164
4,544,041 A 10/1985 Rinaldi
4,545,443 A 10/1985 Wiredal
4,570,706 A 2/1986 Pugnet ..... 166/77.5
4,580,631 A 4/1986 Baugh
4,583,603 A 4/1986 Dorleans et al.
4,589,495 A 5/1986 Langer et al.
4,592,125 A 6/1986 Skene
4,593,584 A 6/1986 Neves
4,593,773 A 6/1986 Skeie ..... 175/85
4,595,058 A 6/1986 Nations
4,604,724 A 8/1986 Shaginian et al. ..... 364/478
4,604,818 A 8/1986 Inoue
4,605,077 A 8/1986 Boyadjieff ..... 175/85
4,605,268 A 8/1986 Meador
4,613,161 A 9/1986 Brisco
4,620,600 A 11/1986 Persson
4,625,796 A 12/1986 Boyadjieff ..... 166/77.5
4,630,691 A 12/1986 Hooper
4,646,827 A 3/1987 Cobb
4,649,777 A 3/1987 Buck ..... 81/57.19
4,651,837 A 3/1987 Mayfield
4,652,195 A 3/1987 McArthur
4,655,286 A 4/1987 Wood
4,667,752 A 5/1987 Berry et al.
4,671,358 A 6/1987 Lindsey, Jr. et al.
4,676,310 A 6/1987 Scherbatskoy et al.
4,676,312 A 6/1987 Mosing et al. ..... 166/77
4,678,031 A 7/1987 Blandford et al.
4,681,158 A 7/1987 Pennison
4,681,162 A 7/1987 Boyd
4,683,962 A 8/1987 True ..... 173/163
4,686,873 A 8/1987 Lang et al.
4,691,587 A 9/1987 Farrand et al.
4,693,316 A 9/1987 Ringgenberg et al.
4,699,224 A 10/1987 Burton
4,709,599 A 12/1987 Buck ..... 81/57.18
4,709,766 A 12/1987 Boyadjieff
4,725,179 A 2/1988 Woolslayer et al.
4,735,270 A 4/1988 Fenyvesi
4,738,145 A 4/1988 Vincent et al.
4,742,876 A 5/1988 Barthelemy et al. ..... 175/7
4,744,426 A 5/1988 Reed
4,759,239 A 7/1988 Hamilton et al. ..... 81/57.34
4,760,882 A 8/1988 Novak
4,762,187 A 8/1988 Haney ..... 175/171
4,765,401 A 8/1988 Boyadjieff ..... 166/77.53
4,765,416 A 8/1988 Bjerking et al.
4,773,689 A 9/1988 Wolters ..... 294/88
4,775,009 A 10/1988 Wittrisch et al.
4,778,008 A 10/1988 Gonzalez et al.
4,781,359 A 11/1988 Matus
4,788,544 A 11/1988 Howard
4,791,997 A 12/1988 Krasnov ..... 175/57
4,793,422 A 12/1988 Krasnov ..... 175/57
4,800,968 A 1/1989 Shaw et al. ..... 175/85
4,806,928 A 2/1989 Veneruso
4,813,493 A 3/1989 Shaw et al. ..... 173/164
4,813,495 A 3/1989 Leach
4,821,814 A 4/1989 Willis et al.
4,825,947 A 5/1989 Mikolajczyk
4,832,552 A 5/1989 Skelly
4,836,064 A 6/1989 Slator ..... 81/57.18
4,836,299 A 6/1989 Bodine
4,842,081 A 6/1989 Parant
4,843,945 A 7/1989 Dinsdale
4,848,469 A 7/1989 Baugh et al.
4,854,386 A 8/1989 Baker et al.
4,867,236 A 9/1989 Haney et al. ..... 166/77.5
4,878,546 A 11/1989 Shaw et al. ..... 173/163
4,880,058 A 11/1989 Lindsey et al.
4,883,125 A 11/1989 Wilson et al.
4,899,816 A 2/1990 Mine
4,901,069 A 2/1990 Veneruso
4,904,119 A 2/1990 Legendre et al.
4,909,741 A 3/1990 Schasteen et al.
4,915,181 A 4/1990 Labrosse
4,921,386 A 5/1990 McArthur
4,936,382 A 6/1990 Thomas
4,960,173 A 10/1990 Cognevich et al.
4,962,579 A 10/1990 Moyer et al.
4,962,819 A 10/1990 Bailey et al.
4,962,822 A 10/1990 Pascale
4,971,146 A 11/1990 Terrell
4,997,042 A 3/1991 Jordan et al. ..... 166/379
5,009,265 A 4/1991 Bailey et al. ..... 166/118
5,022,472 A 6/1991 Bailey et al.
5,027,914 A 7/1991 Wilson
5,036,927 A 8/1991 Willis ..... 175/162
5,049,020 A 9/1991 McArthur
5,052,483 A 10/1991 Hudson
5,060,542 A 10/1991 Hauk
5,060,737 A 10/1991 Mohn
5,062,756 A 11/1991 McArthur et al.
5,069,297 A 12/1991 Krueger
5,074,366 A 12/1991 Karlsson et al.
5,082,069 A 1/1992 Seiler et al.
5,085,273 A 2/1992 Coone
5,096,465 A 3/1992 Chen et al.
5,107,940 A 4/1992 Berry
5,109,924 A 5/1992 Jurgens et al.
5,111,893 A 5/1992 Kvello-Aune
5,141,063 A 8/1992 Quesenbury
34,063 A 9/1992 Vincent et al.
RE34,063 E 9/1992 Vincent et al.
5,148,875 A 9/1992 Karlsson et al.
5,156,213 A 10/1992 George et al.
5,160,925 A 11/1992 Dailey et al.
5,168,942 A 12/1992 Wydrinski 5,172,765 A 12/1992 Sas-Jaworsky
5,176,518 A 1/1993 Hordijk et al.
5,181,571 A 1/1993 Mueller et al.
5,186,265 A 2/1993 Henson et al.
5,191,932 A 3/1993 Seefried et al.
5,191,939 A 3/1993 Stokley ..... 166/379
5,197,553 A 3/1993 Leturno
5,224,540 A 7/1993 Streich et al.
5,233,742 A 8/1993 Gray et al.
5,234,052 A 8/1993 Coone et al.
5,245,265 A 9/1993 Clay
5,251,709 A 10/1993 Richardson ..... 175/220
5,255,741 A 10/1993 Alexander
5,255,751 A 10/1993 Stogner ..... 175/203
5,271,468 A 12/1993 Streich et al.
5,271,472 A 12/1993 Leturno
5,272,925 A 12/1993 Henneuse et al.
5,282,653 A 2/1994 LaFleur et al.
5,284,210 A 2/1994 Helms et al.
5,285,008 A 2/1994 Sas-Jaworsky et al.
5,285,204 A 2/1994 Sas-Jaworsky
5,291,956 A 3/1994 Mueller et al.
5,294,228 A 3/1994 Willis et al.
5,297,833 A 3/1994 Willis et al. ..... 294/102.2
5,305,830 A 4/1994 Wittrisch
5,305,839 A 4/1994 Kalsi et al.
5,318,122 A 6/1994 Murray et al.
5,320,178 A 6/1994 Cornette
5,322,127 A 6/1994 McNair et al.
5,323,858 A 6/1994 Jones et al.
5,332,043 A 7/1994 Ferguson
5,332,048 A 7/1994 Underwood et al.
5,340,182 A 8/1994 Busink et al.
5,343,950 A 9/1994 Hale et al.
5,343,951 A 9/1994 Cowan et al.
5,348,095 A 9/1994 Worrall et al.
5,351,767 A 10/1994 Stogner et al. ..... 175/162
5,353,872 A 10/1994 Wittrisch
5,354,150 A 10/1994 Canales
5,355,967 A 10/1994 Mueller et al.
5,361,859 A 11/1994 Tibbitts
5,368,113 A 11/1994 Schulze-Beckinghausen
5,375,668 A 12/1994 Hallundbaek
5,379,835 A 1/1995 Streich
5,386,746 A 2/1995 Hauk
5,388,651 A 2/1995 Berry ..... 175/85
5,392,715 A 2/1995 Pelrine
5,394,823 A 3/1995 Lenze
5,402,856 A 4/1995 Warren et al.
5,433,279 A 7/1995 Tessari et al. ..... 173/213
5,435,400 A 7/1995 Smith
5,452,923 A 9/1995 Smith
5,458,209 A 10/1995 Hayes et al.
5,461,905 A 10/1995 Penisson
5,472,057 A 12/1995 Winfree
5,477,925 A 12/1995 Trahan et al.
5,494,122 A 2/1996 Larsen et al.
5,497,840 A 3/1996 Hudson
5,501,280 A * 3/1996 Brisco ..... 166/373
5,501,286 A 3/1996 Berry ..... 175/52
5,503,234 A 4/1996 Clanton ..... 175/52
5,520,255 A 5/1996 Barr et al.
5,526,880 A 6/1996 Jordan, Jr. et al.
5,535,824 A 7/1996 Hudson
5,535,838 A 7/1996 Keshavan et al.
5,540,279 A 7/1996 Branch et al.
5,542,472 A 8/1996 Pringle et al.
5,542,473 A 8/1996 Pringle et al.
5,546,317 A 8/1996 Andrieu
5,547,029 A 8/1996 Rubbo et al.
5,551,521 A 9/1996 Vail, III
5,553,672 A 9/1996 Smith, Jr. et al. ..... 166/382
5,553,679 A 9/1996 Thorp
5,560,437 A 10/1996 Dickel et al.
5,560,440 A 10/1996 Tibbitts
5,566,772 A 10/1996 Coone et al.
5,575,344 A 11/1996 Wireman
5,577,566 A 11/1996 Albright et al. ..... 175/321
5,582,259 A 12/1996 Barr
5,584,343 A 12/1996 Coone ..... 166/387
5,588,916 A 12/1996 Moore
5,613,567 A 3/1997 Hudson
5,615,747 A 4/1997 Vail, III
5,645,131 A 7/1997 Trevisani ..... 175/171
5,651,420 A 7/1997 Tibbitts et al.
5,661,888 A 9/1997 Hanslik
5,662,170 A 9/1997 Donovan et al.
5,662,182 A 9/1997 McLeod et al.
5,667,011 A 9/1997 Gill et al.
5,667,023 A 9/1997 Harrell et al.
5,667,026 A 9/1997 Lorenz et al.
5,697,442 A 12/1997 Baldridge
5,706,894 A 1/1998 Hawkins, III
5,706,905 A 1/1998 Barr
5,711,382 A 1/1998 Hansen et al.
5,717,334 A 2/1998 Vail, III et al.
5,720,356 A 2/1998 Gardes
5,730,471 A 3/1998 Schulze-Beckinghausen et al.
5,732,776 A 3/1998 Tubel et al.
5,735,348 A 4/1998 Hawkins, III ..... 166/285
5,735,351 A 4/1998 Helms
5,743,344 A 4/1998 McLeod et al.
5,746,276 A 5/1998 Stuart
5,765,638 A 6/1998 Taylor
5,772,514 A 6/1998 Moore
5,785,132 A 7/1998 Richardson et al.
5,785,134 A 7/1998 McLeod et al.
5,787,978 A 8/1998 Carter et al.
5,791,410 A 8/1998 Castille et al. ..... 166/77.1
5,794,703 A 8/1998 Newman et al.
5,803,191 A 9/1998 Mackintosh ..... 175/170
5,803,666 A 9/1998 Keller
5,813,456 A 9/1998 Milner et al.
5,823,264 A 10/1998 Ringgenberg
5,826,651 A 10/1998 Lee et al.
5,828,003 A 10/1998 Thomeer et al.
5,829,520 A 11/1998 Johnson
5,833,002 A 11/1998 Holcombe
5,836,395 A 11/1998 Budde ..... 166/321
5,836,409 A 11/1998 Vail, III
5,839,330 A 11/1998 Stokka
5,839,515 A 11/1998 Yuan et al.
5,839,519 A 11/1998 Spedale, Jr.
5,842,149 A 11/1998 Harrell et al.
5,842,530 A 12/1998 Smith et al.
5,845,722 A 12/1998 Makohl et al.
5,850,877 A 12/1998 Albright et al.
5,860,474 A 1/1999 Stoltz et al.
5,878,815 A 3/1999 Collins
5,887,655 A 3/1999 Haugen et al.
5,887,668 A 3/1999 Haugen et al.
5,890,537 A 4/1999 Lavaure et al.
5,890,549 A 4/1999 Sprehe
5,894,897 A 4/1999 Vail, III
5,907,664 A 5/1999 Wang et al.
5,908,049 A 6/1999 Williams et al.
5,909,768 A 6/1999 Castille et al. ..... 166/77.1
5,913,337 A 6/1999 Williams et al.
5,921,285 A 7/1999 Quigley et al.
5,921,332 A 7/1999 Spedale, Jr.
5,931,231 A 8/1999 Mock
5,947,213 A 9/1999 Angle et al.
5,950,742 A 9/1999 Caraway
5,954,131 A 9/1999 Sallwasser
5,957,225 A 9/1999 Sinor
5,960,881 A 10/1999 Allamon et al.

5,971,079 A 10/1999 Mullins ..... 166/387
5,971,086 A 10/1999 Bee et al.
5,984,007 A 11/1999 Yuan et al.
5,988,273 A 11/1999 Monjure et al.
6,000,472 A 12/1999 Albright et al. ..... 166/380
6,012,529 A 1/2000 Mikolajczyk et al.
6,024,169 A 2/2000 Haugen
6,026,911 A 2/2000 Angle et al.
6,035,953 A 3/2000 Rear
6,056,060 A 5/2000 Abrahamsen et al. ..... 166/380
6,059,051 A 5/2000 Jewkes et al.
6,059,053 A 5/2000 McLeod
6,061,000 A 5/2000 Edwards
6,062,326 A 5/2000 Strong et al.
6,065,550 A 5/2000 Gardes
6,070,500 A 6/2000 Dlask et al. ..... 81/57.33
6,070,671 A 6/2000 Cumming et al.
6,079,498 A 6/2000 Lima et al.
6,079,509 A 6/2000 Bee et al.
6,082,461 A 7/2000 Newman et al.
6,089,323 A 7/2000 Newman et al.
6,098,717 A 8/2000 Bailey et al.
6,119,772 A 9/2000 Pruet
6,135,208 A 10/2000 Gano et al.
6,142,545 A 11/2000 Penman et al.
6,155,360 A 12/2000 McLeod
6,158,531 A 12/2000 Vail, III
6,161,617 A 12/2000 Gjedebo
6,170,573 B1 1/2001 Brunet et al.
6,172,010 B1 1/2001 Argillier et al.
6,173,777 B1 1/2001 Mullins
6,179,055 B1 1/2001 Sallwasser et al.
6,182,776 B1 2/2001 Asberg
6,186,233 B1 2/2001 Brunet
6,189,616 B1 2/2001 Gano et al.
6,189,621 B1 2/2001 Vail, III
6,196,336 B1 3/2001 Fincher et al.
6,199,641 B1 3/2001 Downie et al. ..... 175/55
6,202,764 B1 3/2001 Ables et al.
6,206,112 B1 3/2001 Dickinson, III et al.
6,216,533 B1 4/2001 Woloson et al.
6,217,258 B1 4/2001 Yamamoto et al.
6,220,117 B1 4/2001 Butcher
6,223,823 B1 5/2001 Head
6,227,587 B1 5/2001 Terral
6,234,257 B1 5/2001 Ciglenec et al.
6,237,684 B1 5/2001 Bouligny, Jr. et al.
6,263,987 B1 7/2001 Vail, III
6,273,189 B1 8/2001 Gissler et al.
6,275,938 B1 8/2001 Bond et al.
6,276,450 B1 8/2001 Seneviratne
6,279,654 B1 8/2001 Mosing et al.
6,290,432 B1 9/2001 Exley et al.
6,296,066 B1 10/2001 Terry et al.
6,305,469 B1 10/2001 Coenen et al.
6,309,002 B1 10/2001 Bouligny ..... 294/86.25
6,311,792 B1 11/2001 Scott et al. ..... 175/162
6,315,051 B1 11/2001 Ayling
6,325,148 B1 12/2001 Trahan et al.
6,334,376 B1 1/2002 Torres
6,343,649 B1 2/2002 Beck et al.
6,347,674 B1 2/2002 Bloom et al.
6,349,764 B1 2/2002 Adams et al. ..... 166/77.53
6,357,485 B2 3/2002 Quigley et al.
6,359,569 B2 3/2002 Beck et al.
6,360,633 B2 3/2002 Pietras ..... 81/57.34
6,367,552 B1 4/2002 Scott et al.
6,367,566 B1 4/2002 Hill
6,371,203 B2 4/2002 Frank et al.
6,374,506 B1 4/2002 Schutte et al.
6,374,924 B1 4/2002 Hanton et al.
6,378,627 B1 4/2002 Tubel et al.
6,378,630 B1 4/2002 Ritorto et al.
6,378,633 B1 4/2002 Moore
6,390,190 B2 5/2002 Mullins
6,392,317 B1 5/2002 Hall et al.
6,397,946 B1 6/2002 Vail, III
6,405,798 B1 6/2002 Barrett et al.
6,408,943 B1 6/2002 Schultz et al.
6,412,554 B1 7/2002 Allen et al. ..... 166/80.1
6,412,574 B1 7/2002 Wardley et al.
6,419,014 B1 7/2002 Meek et al.
6,419,033 B1 7/2002 Hahn et al.
6,427,776 B1 8/2002 Hoffman et al.
6,429,784 B1 8/2002 Beique et al.
6,431,626 B1 8/2002 Bouligny ..... 294/86.25
6,443,241 B1 9/2002 Juhasz et al.
6,443,247 B1 9/2002 Wardley
6,446,723 B1 9/2002 Ramons et al.
6,457,532 B1 10/2002 Simpson
6,458,471 B2 10/2002 Lovato et al.
6,464,004 B1 10/2002 Crawford et al.
6,464,011 B2 10/2002 Tubel
6,484,818 B2 11/2002 Alft et al.
6,497,280 B2 12/2002 Beck et al.
6,527,047 B1 3/2003 Pietras
6,527,064 B1 3/2003 Hallundbaek
6,527,493 B1 3/2003 Kamphorst et al.
6,536,520 B1 3/2003 Snider et al.
6,536,522 B2 3/2003 Birckhead et al.
6,536,993 B2 3/2003 Strong et al.
6,538,576 B1 3/2003 Schultz et al.
6,540,025 B2 4/2003 Scott et al.
6,543,552 B1 4/2003 Metcalfe et al.
6,547,017 B1 4/2003 Vail, III
6,553,825 B1 4/2003 Boyd
6,554,064 B1 4/2003 Restarick et al.
6,585,040 B2 7/2003 Hanton et al.
6,591,471 B1 7/2003 Hollingsworth et al.
6,595,288 B2 7/2003 Mosing et al.
6,619,402 B1 9/2003 Amory et al.
6,622,796 B1 9/2003 Pietras
6,634,430 B2 10/2003 Dawson et al.
6,637,526 B2 10/2003 Juhasz et al.
6,648,075 B2 11/2003 Badrak et al.
6,651,737 B2 11/2003 Bouligny
6,655,460 B2 12/2003 Bailey et al.
6,666,274 B2 12/2003 Hughes
6,668,684 B2 12/2003 Allen et al.
6,668,937 B1 12/2003 Murray
6,679,333 B2 1/2004 York et al.
6,688,394 B1 2/2004 Ayling
6,688,398 B2 2/2004 Pietras
6,691,801 B2 2/2004 Juhasz et al.
6,698,595 B2 3/2004 Norell et al.
6,702,040 B1 3/2004 Sensenig
6,708,769 B2 3/2004 Haugen et al.
6,715,430 B2 4/2004 Choi et al.
6,719,071 B1 4/2004 Moyes
6,725,924 B2 4/2004 Davidson et al.
6,725,938 B1 4/2004 Pietras
6,732,822 B2 5/2004 Slack et al.
6,742,584 B1 6/2004 Appleton
6,742,596 B2 6/2004 Haugen
6,742,606 B2 6/2004 Metcalfe et al.
6,745,834 B2 6/2004 Davis et al.
6,752,211 B2 6/2004 Dewey et al.
6,776,233 B2 8/2004 Meehan
6,832,656 B2 12/2004 Fournier, Jr. et al.
6,832,658 B2 12/2004 Keast
6,837,313 B2 1/2005 Hosie et al.
6,840,322 B2 1/2005 Haynes
6,848,517 B2 2/2005 Wardley
6,854,533 B2 2/2005 Galloway
6,857,486 B2 2/2005 Chitwood et al.
6,857,487 B2 2/2005 Galloway et al.

| | | | |
|---|---|---|---|
| 6,868,906 | B1 | 3/2005 | Vail, III et al. |
| 6,877,553 | B2 | 4/2005 | Cameron |
| 6,892,835 | B2 | 5/2005 | Shahin et al. |
| 6,896,075 | B2 | 5/2005 | Haugen et al. |
| 6,899,186 | B2 | 5/2005 | Galloway et al. |
| 6,899,772 | B1 | 5/2005 | Morando |
| 6,907,934 | B2 | 6/2005 | Kauffman et al. |
| 7,096,977 | B2 | 8/2006 | Juhasz et al. |
| 7,100,698 | B2 | 9/2006 | Kracik et al. |
| 2001/0042625 | A1 | 11/2001 | Appleton ..... 166/379 |
| 2002/0029878 | A1 | 3/2002 | Victor |
| 2002/0040787 | A1 | 4/2002 | Cook et al. |
| 2002/0066556 | A1 | 6/2002 | Goode et al. |
| 2002/0108748 | A1 | 8/2002 | Keyes |
| 2002/0134555 | A1 | 9/2002 | Allen et al. ..... 166/377 |
| 2002/0170720 | A1 | 11/2002 | Haugen |
| 2002/0189863 | A1 | 12/2002 | Wardley |
| 2003/0029641 | A1 | 2/2003 | Meehan |
| 2003/0056947 | A1 | 3/2003 | Cameron |
| 2003/0056991 | A1 | 3/2003 | Hahn et al. |
| 2003/0070841 | A1 | 4/2003 | Merecka et al. |
| 2003/0070842 | A1 | 4/2003 | Bailey et al. |
| 2003/0111267 | A1 | 6/2003 | Pia |
| 2003/0141111 | A1 | 7/2003 | Pia |
| 2003/0146023 | A1 | 8/2003 | Pia |
| 2003/0155158 | A1 | 8/2003 | Slack et al. |
| 2003/0164250 | A1 | 9/2003 | Wardley |
| 2003/0164251 | A1 | 9/2003 | Tulloch |
| 2003/0164276 | A1 | 9/2003 | Snider et al. |
| 2003/0173073 | A1 | 9/2003 | Snider et al. |
| 2003/0173090 | A1 | 9/2003 | Cook et al. |
| 2003/0213598 | A1 | 11/2003 | Hughes |
| 2003/0217865 | A1 | 11/2003 | Simpson et al. |
| 2003/0221519 | A1 | 12/2003 | Haugen et al. |
| 2004/0000405 | A1 | 1/2004 | Fournier, Jr. et al. |
| 2004/0003490 | A1 | 1/2004 | Shahin et al. |
| 2004/0003944 | A1 | 1/2004 | Vincent et al. |
| 2004/0011534 | A1 | 1/2004 | Simonds et al. |
| 2004/0060697 | A1 | 4/2004 | Tilton et al. |
| 2004/0069500 | A1 | 4/2004 | Haugen |
| 2004/0079533 | A1 | 4/2004 | Buytaert et al. |
| 2004/0108142 | A1 | 6/2004 | Vail, III |
| 2004/0112603 | A1 | 6/2004 | Galloway et al. |
| 2004/0112646 | A1 | 6/2004 | Vail |
| 2004/0118613 | A1 | 6/2004 | Vail |
| 2004/0118614 | A1 | 6/2004 | Galloway et al. |
| 2004/0123984 | A1 | 7/2004 | Vail |
| 2004/0124010 | A1 | 7/2004 | Galloway et al. |
| 2004/0124011 | A1 | 7/2004 | Gledhill et al. |
| 2004/0124015 | A1 | 7/2004 | Vaile et al. |
| 2004/0129456 | A1 | 7/2004 | Vail |
| 2004/0140128 | A1 | 7/2004 | Vail |
| 2004/0144547 | A1 | 7/2004 | Koithan et al. |
| 2004/0173358 | A1 | 9/2004 | Haugen |
| 2004/0216892 | A1 | 11/2004 | Giroux et al. |
| 2004/0216924 | A1 | 11/2004 | Pietras et al. |
| 2004/0216925 | A1 | 11/2004 | Metcalfe et al. |
| 2004/0221997 | A1 | 11/2004 | Giroux et al. |
| 2004/0226751 | A1 | 11/2004 | McKay et al. |
| 2004/0244992 | A1 | 12/2004 | Carter et al. |
| 2004/0245020 | A1 | 12/2004 | Giroux et al. |
| 2004/0251025 | A1 | 12/2004 | Giroux et al. |
| 2004/0251050 | A1 | 12/2004 | Shahin et al. |
| 2004/0251055 | A1 | 12/2004 | Shahin et al. |
| 2004/0262013 | A1 | 12/2004 | Tilton et al. |
| 2005/0000691 | A1 | 1/2005 | Giroux et al. |
| 2005/0051343 | A1 | 3/2005 | Pietras et al. |
| 2005/0096846 | A1 | 5/2005 | Koithan et al. |
| 2005/0098352 | A1 | 5/2005 | Beierbach et al. |

FOREIGN PATENT DOCUMENTS

| | | | |
|---|---|---|---|
| CA | 2 335 192 | | 11/2001 |
| DE | 3 213 464 | | 10/1983 |
| DE | 3 523 221 | | 2/1987 |
| DE | 3 918 132 | | 12/1989 |
| DE | 4 133 802 | | 10/1992 |
| EP | 0 087 373 | | 8/1983 |
| EP | 0 162 000 | | 11/1985 |
| EP | 0 162 000 | A1 | 11/1985 |
| EP | 0 171 144 | | 2/1986 |
| EP | 0171 144 | | 2/1986 |
| EP | 0 235 105 | | 9/1987 |
| EP | 0 265 344 | | 4/1988 |
| EP | 0 285 386 | | 10/1988 |
| EP | 0 285 386 | A2 | 10/1988 |
| EP | 0 426 123 | | 5/1991 |
| EP | 0 474 481 | | 3/1992 |
| EP | 0479583 | | 4/1992 |
| EP | 0 525 247 | | 2/1993 |
| EP | 0 525 247 | A1 | 2/1993 |
| EP | 0 554 568 | | 8/1993 |
| EP | 0 589 823 | | 3/1994 |
| EP | 0 589 823 | A1 | 3/1994 |
| EP | 0 659 975 | | 6/1995 |
| EP | 0 790 386 | | 8/1997 |
| EP | 0 881 354 | | 4/1998 |
| EP | 0 571 045 | | 8/1998 |
| EP | 0 961 007 | | 12/1999 |
| EP | 0 962 384 | | 12/1999 |
| EP | 1 006 260 | | 6/2000 |
| EP | 1 050 661 | | 11/2000 |
| EP | 1148206 | | 10/2001 |
| EP | 1 256 691 | | 11/2002 |
| FR | 2053088 | | 7/1970 |
| FR | 2741907 | | 6/1997 |
| FR | 2 841 293 | | 12/2003 |
| GB | 540 027 | | 10/1941 |
| GB | 709 365 | | 5/1954 |
| GB | 716 761 | | 10/1954 |
| GB | 7 928 86 | | 4/1958 |
| GB | 8 388 33 | | 6/1960 |
| GB | 881 358 | | 11/1961 |
| GB | 9 977 21 | | 7/1965 |
| GB | 1 277 461 | | 6/1972 |
| GB | 1 306 568 | | 3/1973 |
| GB | 1 448 304 | | 9/1976 |
| GB | 1 469 661 | | 4/1977 |
| GB | 1 582 392 | | 1/1981 |
| GB | 2 053 088 | | 2/1981 |
| GB | 2 115 940 | | 9/1983 |
| GB | EP 0171 144 | | 2/1986 |
| GB | 2 170 528 | | 8/1986 |
| GB | 2 201 912 | | 9/1988 |
| GB | 2 216 926 | | 10/1989 |
| GB | 2 223 253 | | 4/1990 |
| GB | 2 224 481 | | 9/1990 |
| GB | 2 224 481 | A | 9/1990 |
| GB | 2 240 799 | | 8/1991 |
| GB | 2 275 486 | | 4/1993 |
| GB | 2 275 486 | A | 4/1993 |
| GB | 2 294 715 | | 8/1996 |
| GB | 2 313 860 | | 2/1997 |
| GB | 2 320 270 | | 6/1998 |
| GB | 2 324 108 | | 10/1998 |
| GB | 2 333 542 | | 7/1999 |
| GB | 2 335 217 | | 9/1999 |
| GB | 2 345 074 | | 8/2000 |
| GB | 2 347 445 | | 9/2000 |
| GB | 2 348 223 | | 9/2000 |
| GB | 2 349 401 | | 11/2000 |
| GB | 2 350 137 | | 11/2000 |
| GB | 2 365 463 | | 2/2001 |
| GB | 2 357 101 | | 6/2001 |
| GB | 2 357 530 | | 6/2001 |
| GB | 2 357 530 | A | 6/2001 |

| | | |
|---|---|---|
| GB | 2 352 747 | 7/2001 |
| GB | 2 372 271 | 8/2002 |
| GB | 2 372 765 | 9/2002 |
| GB | 2 381 809 | 5/2003 |
| GB | 2 382 361 | 5/2003 |
| GB | 2 386 626 | 9/2003 |
| GB | 2 389 130 | 12/2003 |
| RU | 2 079 633 | 5/1997 |
| WO | WO 90-06418 | 6/1990 |
| WO | WO 91-16520 | 10/1991 |
| WO | WO 92-01139 | 1/1992 |
| WO | WO 92-18743 | 10/1992 |
| WO | WO 92-20899 | 11/1992 |
| WO | WO 93/07358 | 4/1993 |
| WO | WO 93-24728 | 12/1993 |
| WO | WO 95-10686 | 4/1995 |
| WO | WO 96/18799 | 6/1996 |
| WO | WO 96-28635 | 9/1996 |
| WO | WO 97-05360 | 2/1997 |
| WO | WO 97-08418 | 3/1997 |
| WO | WO 98/01651 | 1/1998 |
| WO | WO 98/05844 | 2/1998 |
| WO | WO 98-09053 | 3/1998 |
| WO | WO 98/11322 | 3/1998 |
| WO | WO 98/32948 | 7/1998 |
| WO | WO 98-55730 | 12/1998 |
| WO | WO 99-04135 | 1/1999 |
| WO | WO 99-11902 | 3/1999 |
| WO | WO 99-23354 | 5/1999 |
| WO | WO 99-24689 | 5/1999 |
| WO | WO 99/35368 | 7/1999 |
| WO | WO 99-37881 | 7/1999 |
| WO | WO 99/41485 | 8/1999 |
| WO | WO 99-50528 | 10/1999 |
| WO | WO 99/58810 | 11/1999 |
| WO | WO 99-64713 | 12/1999 |
| WO | WO 00/04269 | 1/2000 |
| WO | WO 00-08293 | 2/2000 |
| WO | WO 00/09853 | 2/2000 |
| WO | WO 00/05483 | 3/2000 |
| WO | WO 00/11309 | 3/2000 |
| WO | WO 00/11310 | 3/2000 |
| WO | WO 00/11311 | 3/2000 |
| WO | WO 00-28188 | 5/2000 |
| WO | WO 00-37766 | 6/2000 |
| WO | WO 00-37771 | 6/2000 |
| WO | WO 00/39429 | 7/2000 |
| WO | WO 00/39430 | 7/2000 |
| WO | WO 00/41487 | 7/2000 |
| WO | WO 00/46484 | 8/2000 |
| WO | WO 00-50730 | 8/2000 |
| WO | WO 00/52297 | 9/2000 |
| WO | WO 00/66879 | 11/2000 |
| WO | WO 01-12946 | 2/2001 |
| WO | WO 01/33033 | 5/2001 |
| WO | WO 01-46550 | 6/2001 |
| WO | WO 01/59253 | 8/2001 |
| WO | WO 01-79650 | 10/2001 |
| WO | WO 01/79652 | 10/2001 |
| WO | WO 01-81706 | 11/2001 |
| WO | WO 01-83932 | 11/2001 |
| WO | WO 01-94738 | 12/2001 |
| WO | WO 01-94739 | 12/2001 |
| WO | WO 02/14649 | 2/2002 |
| WO | WO 02/44601 | 6/2002 |
| WO | WO 02/081863 | 10/2002 |
| WO | WO 02-086287 | 10/2002 |
| WO | WO 03/006790 | 1/2003 |
| WO | WO 03-074836 | 9/2003 |
| WO | WO 03/087525 | 10/2003 |
| WO | WO 2004/022903 | 3/2004 |
| WO | WO 04/079155 | 9/2004 |

OTHER PUBLICATIONS

Valves Wellhead Equipment Safety Systems, W-K-M Division, ACF Industries, Catalog 80, 1980, 5 Pages.

"Canrig Top Drive Drilling Systems," Harts Petroleum Engineer International, Feb. 1997, 2 Pages.

"The Original Portable Top Drive Drilling System," TESCO Drilling Technology, 1997.

Killalea, Mike, "Portable Top Drives: What's Driving The Market?" IADC, Drilling Contractor, Sep. 1994, 4 Pages.

"500 or 650 ECIS Top Drive," Advanced permanent Magnet Motor Technology, TESCO Drilling Technology, Apr. 1998, 2 Pages.

"500 or 650 HCIS Top Drive," Powerful Hydraulic Compact Top Drive Drilling System, TESCO Drilling Technology, Apr. 1998, 2 Pages.

"Product Information (Sections 1-10)," CANRIG Drilling Technology, Ltd. Sep. 18, 1996.

Detlef Hahn, Friedhelm Makohl, and Larry Watkins, Casing-While Drilling System Reduces Hole Collapse Risks, Offshore, pp. 54, 56, and 59, Feb. 1998.

Yakov A. Gelfgat, Mikhail Y. Gelfgat and Yuri S. Lopatin, Retractable Drill Bit Technology—Drilling Without Pulling Out Drillpipe, Advanced Drilling Solutions Lessons From the FSU; Jun. 2003; vol. 2, pps. 351-464.

Tommy Warren, SPE, Bruce Houtchens, SPE, Garret Madell, SPE, Directional Drilling With Casing, SPE/IADC 79914, Tesco Corporation, SPE/IADC Drilling Conference 2003.

Canrig Top Drive Drilling Systems, Harts Petroleum Engineer International, Feb. 1997, 2 Pages.

The Original Portable Top Drive Drilling System, TESCO Drilling Technology, 1997.

Mike Killalea, Portable Top Drives: What's Driving The Marked?, IADC, Drilling Contractor, Sep. 1994, 4 Pages.

500 or 650 ECIS Top Drive, Advanced Permanent Magnet Motor Technology, TESCO Drilling Technology, Apr. 1998, 2 Pages.

500 or 650 HCIS Top Drive, Powerful Hydraulic Compact Top Drive Drilling System, TESCO Drilling Technology, Apr. 1998, 2 Pages.

Product Information (Sections 1-10) CANDRIG Drilling Technology, Ltd., Sep. 18, 1996.

U.S. Appl. No. 10/189,570, filed Jun. 6, 2002 (WEAT/0411).

U.S. Appl. No. 10/618,093, filed Jul. 11, 2003 (WEAT/0403).

Hahn, et al., "Simultaneous Drill and Case Technology - Case Histories, Status and Options for Further Development," Society of Petroleum Engineers, IADC/SPE Drilling Conference, New Orlean, LA Feb. 23-25, 2000 pp. 1-9.

M.B. Stone and J. Smith, "Expandable Tubulars and Casing Driling are Options" Drilling Contractor, Jan./Feb. 2002, pp. 52.

M. Gelfgat, "Retractable Bits Development and Application" Transactions of the ASME, vol. 120, Jun. (1998), pp. 124-130.

"First Success with Casing-Drilling" Word Oil, Feb. (1999), p.25.

Dean E. Gaddy, Editor, "Russia Shares Technical Know-How with U.S." Oil & Gas Journal, Mar. (1999), pp. 51-52 and 54-56.

Rotary Steerable Technology - Technology Gains Momentum, Oil & Gas Journal, Dec. 28, 1998.

Directional Drilling, M. Mims, World Oil, May 1999, pp. 40-43.

Multilateral Classification System w/Example Applications, Alan MacKenzie & Cliff Hogg, World Oil, Jan. 1999, pp. 55-61.

Tarr, et al., "Casing-while-Drilling: The Next Step Change in Well Construction," World Oil, Oct. 1999, pp. 34-40.

De Leon Mojarro, "Breaking A Paradigm: Drilling With Tubing Gas Wells," SPE Paper 40051, SPE Annual Technical Conference and Exhibition, Mar. 3-5, 1998, pp. 465-472.

Littleton, "Refined Slimhole Drilling Technology Renews Operator Interest," Petroleum Engineer International, Jun. 1992, pp. 19-26.

Anon, "Slim Holes Fat Savings," Journal of Petroleum Technology, Sep. 1992, pp. 816-819.

Anon, "Slim Holes, Slimmer Prospect," Journal of Petroleum Technology, Nov. 1995, pp. 949-952.

Vogt, et al., "Drilling Liner Technology for Depleted Reservoir," SPE Paper 36827, SPE Annual Technical Conference and Exhibiton, Oct. 22-24, pp. 127-132.
Mojarro, et al., "Drilling/Completing With Tubing Cuts Well Costs by 30%," World Oil, Jul. 1998, pp. 145-150.
Sinor, et al., Rotary Liner Drilling for Depleted Reservoirs, IADC/SPE Paper 39399, IADC/SPE Drilling Conference, Mar. 3-6, 1998, pp. 1-13.
Editor, "Innovation Starts at the Top at Tesco," The American Oil & Gas Reporter, Apr. 1998, p. 65.
Tessari, et al., "Casing Drilling - A Revolutionary Approach to Reducing Well Costs," SPE/IADC Paper 52789, SPE/IADC Drilling Conference, Mar. 9-11, 9999, pp. 221-229.
Silverman, "Novel Drilling Method - Casing Drilling Process Eliminates Tripping String," Petroleum Engineer International, Mar. 1999, p. 15.
Silverman, "Drilling Technology - Retractable Bit Eliminates Drill String Trips," Petroleum Engineer International, Apr. 1999, p. 15.
Laurent, et al., "A New Generation Drilling Rig: Hydrautically Powered and Computer Controlled," CADE/CAODC Paper 99-120, CADE/CAODC Spring Drilling Conference, Apr. 7 & 8, 1999, 14 pages.
Madell, et al., "Casing Drilling An Innovative Approach to Reducing Drilling Costs," CADE/CAODC Paper 99-121, CADE/CAODC Spring Drilling Conference, Apr. 7 & 8, 1999, pp. 1-12.
Tessari, et al., "Focus: Drilling With Casing Promises Major Benefits," Oil & Gas Journal, May 17, 1999, pp. 58-62.
Laurent, et al., "Hydraulic Rig Supports Casing Drilling," World Oil, Sep. 1999, pp. 61-68.
Perdue, et al., "Casing Technology Improves," Hart's E & P, Nov. 1999, pp. 135-136.
Warren, et al., "Casing Drilling Application Design Considerations," IADC/SPE Paper 59179, IADC/SPE Drilling Conference, Feb. 23-25, 2000 pp. 1-11.
Warren, et al., "Drilling Technology: Part I - Casing Drilling With Directional Steering in The U.S. Gulf of Mexico," Offshore, Jan. 2001, pp. 50-52.
Warren, et al., "Drilling Technology: Part II - Casing Drilling With Directional Steering in the Gulf of Mexico," Offshore, Feb. 2001, pp. 40-42.
Shepard, et al., "Casing Drilling: An Emerging Technology," IADC/SPE Paper 67731, SPE/IADC Drilling Conference, Feb. 27-Mar. 1, 2001, pp. 1-13.
Editor, "Tesco Finishes Field Trial Program," Drilling Contractor, Mar./Apr. 2001, p. 53.
Warren, et al., "Casing Drilling Technology Moves to More Challenging Application," AADE Paper 01-NC-HO-32, AADE National Drilling Conference, Mar. 27-29, 2001, pp. 1-10.
Shephard, et al., "Casing Drilling: An Emerging Technology," SPE Drilling & Completion, Mar. 2002, pp. 4-14.
Shephard, et al., "Casing Drilling Successfully Applied in Southern Wyoming," World Oil, Jun. 2002, pp. 33-41.
Forest, et al., "Subsea Equipment for Deep Water Drilling Using Gradient Mud System," SPE/IADC Drilling Conference, Amsterdam, The Netherlands, Feb. 27, 2001-Mar. 1, 2001, 8 pages.
World's First Drilling With Casing Operation From a Floating Drilling Unit, Sep. 2003, 1 page.
Filippov, et al., "Expandable Tubular Solutions," SPE paper 56500, SPE Annual Technical Conference and Exhibition, Oct. 3-6, 1999, pp. 1-16.
Coronado, et al., "Development of a One-Trip ECP Cement Inflation and Stage Cementing System for Open Hole Completions," IADC/SPE Paper 39345, IADC/SPE Drilling Conference, Mar. 3-6, 1998, pp. 473-481.
Coronado, et al., "A One-Trip External-Casing-Packer Cement-Inflation and Stage-cementing System," Journal of Petroleum Technology, Aug. 1998, pp. 76-77.
Quigley, "Coiled Tubing and Its Applications," SPE Short Course, Houston, Texas, Oct. 3, 1999, 9 pages.
Bayfiled, et al., "Burst and Collapse of a Sealed Multilayered Junction: Numerical Simulations," SPE/IADC Paper 52873, SPE/IADC Drilling Conference, Mar. 9-11, 1999, 8 pages.
Marker, et al., "Anaconda: Joint Development Project Leads to Digitally Controlled Composite Coiled Tubing Drilling System," SPE paper 60750, SPE/ICOTA Coiled Tubing Roundtable, Apr. 5-6, 2000, pp. 1-9.
Cales, et al., Subsidence Remediation - Extending Well Life Through the Use of solid Expandable Casing Systems, AADE Paper 01-NC-HO-24, American Association of Drilling Engineers, Mar. 2001 Conference, pp. 1-16.
Coats, et al., "The Hybrid Drilling Unite: An Overview of an Integrated Composite Coiled Tubing and Hydraulic Workover Drilling System," SPE Paper 74349, SPE International Petroleum Conference and Exhibition, Feb. 10-12, 2002, pp. 1-7.
Sander, et al., "Project Management and Technology Provide Enhanced Performance for Shallow Horizontal Wells," IADC/SPE Paper 74466, IADC/SPE Drilling Conference, Feb. 26-28, 2002, pp. 1-9.
Coats, et al., "The Hybrid Drilling System: Incorporating Composite Coiled Tubing and Hydraulic Workover Technologies into One Integrated Drilling System," IADC/SPE Paper 74538, IADC/SPE Drilling Conference, Feb. 26-28, 2002, pp. 1-7.
Galloway, "Rotary Drilling With Casing-A Field Proven Method of Reducing Wellbore Construction Cost," Paper WOCD-0306092, World Oil Casing Drilling Technical Conference, Mar. 6-7, 2003, pp. 1-7.
Fontenot, et al., "New Rig Design Enhances Casing Drilling Operations in Lobo Trend," paper WOCD-0306-04, World Oil Casing Drilling Technicval Conference, Mar. 6-7, 2003, pp. 1-13.
McKay, et al., "New Development in the Technology of Drilling With Casing: Utilizing a Displaceable Drillshoe Tool," Paper WOCD-0306-05, World Oil Casing Drilling Technical Conference, Mar. 6-7, 2003, pp. 1-11.
Sutriono - Santos, et al., "Drilling With Casing Advances to Floating Drilling Unit With Surface BOP Employed," Paper WOCD-0307-01, World Oil Casing Drilling Technical Conference, Mar. 6-7, 2003, pp. 1-7.
Vincent, et al., "Linear and Casing Drilling - Case Histories and Technology," Paper WOCD-0307-02, World Oil Casing Drilling Technical Conference, Mar. 6-7, 2003, pp. 1-20.
Mauta, "Electrical Logging: State-of-the-Art," The Log Analyst, May-Jun. 1992, pp. 206-27.
Tessari, et al., "Retrievable Tools Provide Flexibility for Casing Drilling," Paper No. WOCD-0306-01, World Oil Casing Drilling Technical Conference, 2003, pp. 1-11.
Evans, et al., "Development and Testing of an Economical Casing Connection For Use in Drilling Operations," paper WOCD-0306-03, World Oil Casing Drilling Technical Conference, Mar. 6-7, 2003, pp. 1-10.
Dennis L. Bickford and Mark J. Mabile, Casing Drilling Rig Selection For Stratton Field, Texas, World Oil, vol. 226 No., Mar. 2005.
G. H. Kamphorst, G. L. Van Wechem, W. Boom, D. Bottger, and K. Koch, Casing Running Tool, SPE/IADC 52770.
Alexander Sas-Jaworsky and J. G. Williams, Development of Composite Coiled Tubing for Oilfield Services, SPE 26536, Society of Petroleum Engineers, Inc., 1993.
A. S. Jafar, H. H. Al-Attar, and I. S. El-Ageli, Discussion and Comparison of Performance of Horizontal Wells in Bouri Field, SPE 26927, Society of Petroleum Engineers, Inc. 1996.
G. F. Boykin, The Role of A Worldwide Drilling Organization and the Road to the Future, SPE/IDAC 37630, 1997.
M. S. Fuller, M. Littler, and I. Pollock, Innovative Wat to Cement a Liner Utitizing a New Inner String Liner Cementing Process, 1998.
Helio Santos, Consequences and Revelance of Drillstring Vibration on Wellbore Stability, SPE/IDAC 52820, 1999.
Chan L. Daigle, donald B. Campo, carey J. Naquin, Rudy Cardenas, Lev M. Ring, Patrick L. York, Expandable Tubulars: Field Examples of Application in Well Construction and Remediation, SPE 62958, Society of Petroleum Engineers Inc., 2000.
C. Lee Lohoefer, Ben Mathis, David Brisco, Kevin Waddell, Lev Ring, and Patrick York, Expandable Liner Hanger Provides Cost-Effective Alternative Solution, IDAC/SPE 59151, 2000.

Kenneth K. Dupal, Donald B. Campo, John E. Lofton, Don Weisinger, R. Lance Cook, Michael D. Bullock, Thomas P. Grant, and Patrick L. York, Solid Expandable Tubular Technology - A Year of Case Histories in the Drilling Environment, SPE/IADC 67770, 2001.

Mike Bullock, Tom Grant, Rick Sizemore, Chan Daigle, and Pat York, Using Expandable Solid Tubulars to Solve Well Construction Challenges in Deep Waters and Maturing Properities, 18P 27500, Brazilian Petroleum Institute - IBP, 2000.

Coiled Tubing Handbook, World Oil, Gulf Publishing Company, 1993.

* cited by examiner

APPARATUS AND METHOD FOR FACILITATING THE CONNECTION OF TUBULARS USING A TOP DRIVE

CROSS-REFERENCE TO RELATED APPLICATIONS

This application is a continuation of co-pending U.S. patent application Ser. No. 09/868,790, filed Sep. 4, 2001, now U.S. Pat. No. 6,725,938, which is the National State of International Application No. PCT/GB 99/03951, filed on Nov. 29, 1999, and published under PCT Article 21(2) in English, which claims priority of United Kingdom Application Serial No. GB9828673.5, filed on Dec. 24, 1998. The aforementioned applications are herein incorporated by reference in their entirety.

BACKGROUND OF THE INVENTION

This invention relates to an apparatus and method for facilitating the connection of tubulars using a top drive and is, more particularly but not exclusively, intended for facilitating the connection of a section or stand of casing to a string of casing.

SUMMARY OF THE INVENTION

In the construction of oil or gas wells it is usually necessary to line the borehole with a string of tubulars known as casing. Because of the length of the casing required, sections or stands of say two or three sections of casing are progressively added to the string as it is lowered into the well from a drilling platform. In particular, when it is desired to add a section or stand of casing the string is usually restrained from falling into the well by applying the slips of a spider located in the floor of the drilling platform. The new section or stand of casing is then moved from a rack to the well centre above the spider. The threaded pin of the section or stand of casing to be connected is then located over the threaded box of the casing in the well and the connection is made up by rotation therebetween. An elevator is then connected to the top of the new section or stand and the whole casing string lifted slightly to enable the slips of the spider to be released. The whole casing string is then lowered until the top of the section is adjacent the spider whereupon the slips of the spider are re-applied, the elevator disconnected and the process repeated.

It is common practice to use a power tong to torque the connection up to a predetermined torque in order to make the connection. The power tong is located on the platform, either on rails, or hung from a derrick on a chain. However, it has recently been proposed to use a top drive for making such connection.

Because of the high costs associated with the construction of oil and gas wells time is critical and it has been observed by the applicants that the time to connect a tubular to a top drive using existing equipment could be reduced.

It has been observed that sections or stands of tubulars are often not as uniform as desired. In particular, the sections or stands of tubulars are often not straight. The top drive is in perfect alignment with the centre of the spider in the platform of an oil or gas rig. However, a section or stand of tubulars located in the spider would not always be in alignment with the top drive.

There is described an apparatus and method for facilitating the connection of tubulars using a top drive in co-pending UK Patent Application No. 98 18363.5, which apparatus comprises a stator attachable to the top drive and a supporting member for supporting a tool wherein means are provided to allow substantially horizontal movement of said supporting member.

The apparatus disclosed therein is bulky, cumbersome and awkward to use. The present invention attempts to reduce these problems.

Accordingly, there is provided an apparatus for facilitating the connection of tubulars using a top drive, the apparatus comprising a supporting member for connection with said top drive, a tool for gripping a tubular and means for allowing substantially horizontal movement therebetween wherein said means comprises a flexible membrane enclosing a fluid.

Other features of the invention are set out in Claims.

There is also provided a method for facilitating the connection of tubulars, the method comprising the steps of moving a tool for gripping a tubular substantially in a horizontal plane relative to a supporting member whereupon a flexible membrane located therebetween is deformed.

BRIEF DESCRIPTION OF THE DRAWINGS

For a better understanding of the present invention, reference will now be made, by way of example, to the accompanying drawings, in which.

DETAILED DESCRIPTION

Figure 1:
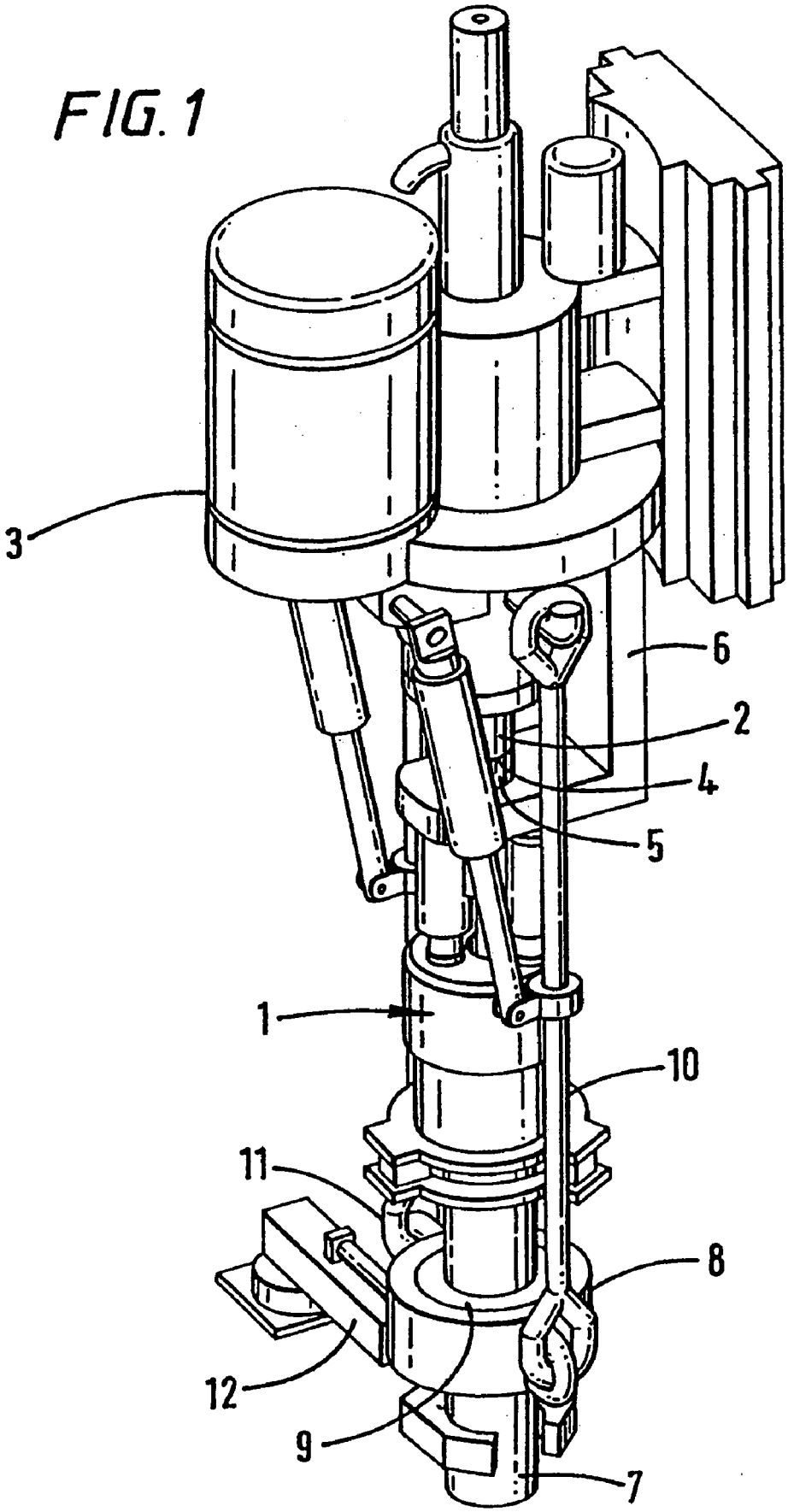
FIG. 1 is a view in perspective of an apparatus according to the invention the apparatus being shown in use.
Figure 2:
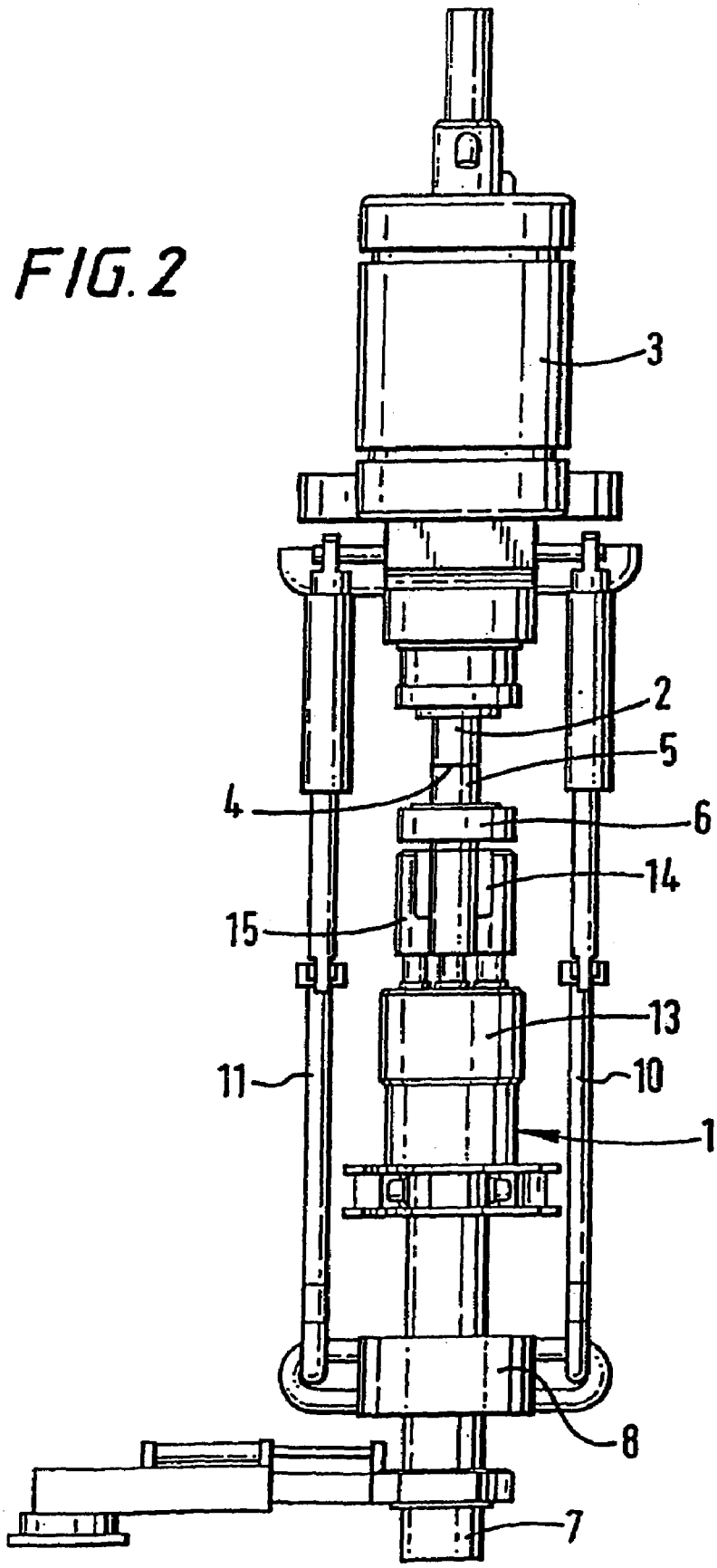
FIG. 2 is a front plan view of the apparatus of FIG. 1, the apparatus being shown in use.
Figure 3:
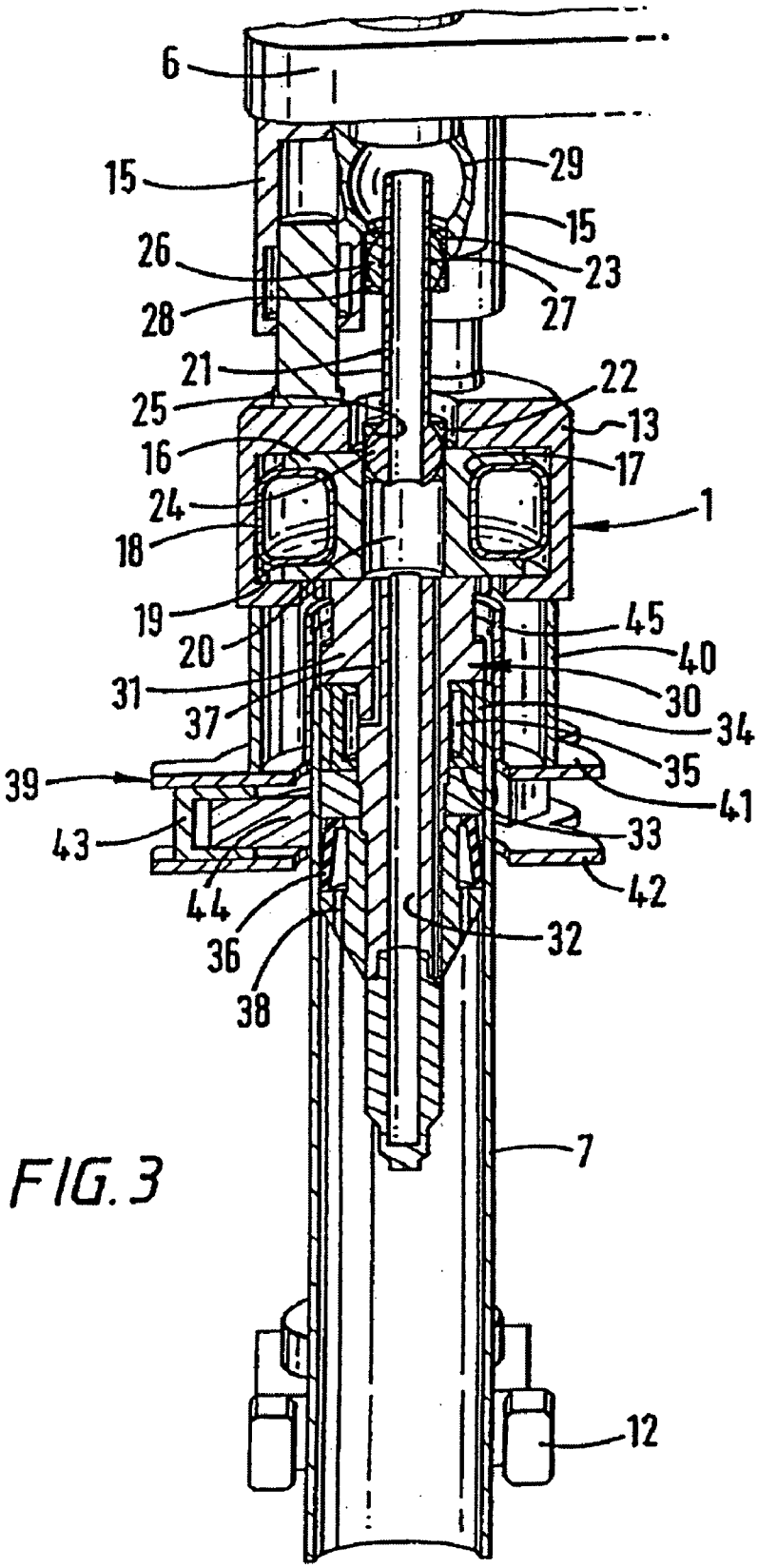
FIG. 3 is an enlarged cross-sectional view of parts of FIG. 1.

Referring to the drawings, there is shown an apparatus for facilitating the connection of tubulars using a top drive. The apparatus is generally identified by reference numeral 1.

The apparatus 1 is shown connected to a rotor 2 of a top drive 3 via connection 4 to a rotor 5 of the apparatus 1. The top drive 3 is located on rails on a derrick of a rig (not shown). A rigid member 6 is fast with a static part of the top drive 3. The rigid member surrounds the rotor 5. The rigid member 6 has a clamp therein which, when required, applies jaws (not shown) to the rotor 5 such that, upon rotation of the rotor 2 of the top drive 3, the apparatus 1 may be connected or disconnected from the top drive 3. When the jaws are released, the rotor 5 may rotate freely within the rigid member 6.

The apparatus 1 is shown with a stand of casing 7 inserted therein. An elevator 8 is shown gripping the stand of casing 7 with the use of gripping elements 9. The elevator 8 is suspended from the top drive 3 on bails 10 and 11. The stand of casing 7 is guided by a pipe handling arm 12.

The apparatus 1 comprises a housing 13 which depends from the rotor 5 via a supporting element 14 and three piston and cylinders 15. The three piston and cylinders 15 allow small vertical movements of the apparatus 1 relative to the top drive 3. The three pistons and cylinders 15 may be hydraulically activated or pneumatically activated or using a combination of both pneumatic and hydraulic fluids.

The housing 13 accommodates a hub 16 which is radially and rotationally moveable therein. The hub 16 has a circumferential recess 17 into which an inflatable ring 18 is arranged. The inflatable ring 18 is in frictional engagement with both the hub 16 and an internal wall 19 of the housing 13. The hub 16 has a central bore 20 into which one end of a mud pipe 21 is inserted. The mud pipe 21 is provided for carrying mud to the inside of the tubular 7. The mud pipe 21 is mounted in cylindrical sections 22 and 23 which are attached to the hub 16 and the supporting element 14 respectively. The mud pipe 21 is provided with a lobe 24 formed on the outer surface thereof and is located in a corresponding recess 25 in the cylindrical section 22. A lobe 26 is slidably arranged on the upper end of the mud pipe 21 with an o-ring seal 27 arranged therebetween to inhibit fluid from leaking therebetween. The lobe 26 is located in a corresponding recess 28 in the cylindrical section 23. This arrangement allows a ball and socket type movement between the supporting element 14 and the hub 16 and relative longitudinal movement therebetween. The upper end of the mud pipe 21 is allowed to move freely in a spherical recess 29 in the supporting element 14.

A circulating tool generally identified by reference numeral 30 is fixed to and depends from the hub 16. The circulating tool 30 comprises a cylindrical body 31 which has a central passage 32 therethrough. The cylindrical body 31 has a plurality of recesses 33 thereabout in which gripping elements 34 are located. The gripping elements 34 are provided with recesses 35.

The cylindrical body 31 is also provided with an inflatable sealing ring 36 arranged below the gripping elements 34.

The cylindrical body 31 is provided with a feed passage 37 the upper end of which is connected to a hydraulic fluid supply and at the other end to the recesses 35 in the gripping elements 34. A feed passage 38 connects the inflatable sealing ring 36 with the inside of the tubular 7.

A clamping device 39 depends from the housing 13 on a rigid cylinder 40. The clamping device 39 comprises two rigid plates 41 and 42 between which is arranged three hydraulic pistons 43 spaced at 1200 to each other. The hydraulic pistons 43 are provided with gripping elements 44 for engaging with the tubular 7.

In use, the apparatus I is fitted to the rotor 2 of a top drive 3 via the rotor 5 of the apparatus 1. When it is desired to connect a stand of tubulars such as casing to a string of casing already lowered into a wellbore and suspended from a spider in the rig floor (not shown), the following steps are performed.

A stand of casing is moved from a storage area to the well centre, and is gripped by the pipe handling arm 12. The pipe handling arm 12, if necessary, moves the stand of casing to a position where the apparatus 1 may be lowered onto the top of the stand of casing. The apparatus 1 is lowered with the top drive 3 on the rails on the derrick of the rig. As the apparatus 1 is lowered, the circulating tool 30 inserts itself inside the stand of casing and the clamping device 39 passes over the box 45 of the casing 7.

The gripping elements 34 are moved radially outwardly by the hydraulic fluid pressure build up through feed passage 37 and into recess 35. The gripping elements engage with the internal wall of the casing 7. It should be noted that the weight of the stand of casing may now be taken by the gripping elements 34. The pipe handling arm 12 can now move the stand of casing into exact alignment with the box of the casing string protruding above the spider in the rig floor. This step is necessary due to the stands of casing being slightly bent. As the stand of casing 7 moves, the circulating tool 30 moves with the casing 7. The pneumatic fluid in the inflatable ring 18 allows relative movement between the stationary top drive 3 and circulating tool and hence the casing 7. Once aligned, the stand of casing is lowered ("stabbed") into the box of the casing string by activation of piston and cylinders 15. Low torque rotation of the stand of casing now begins by rotation of the top drive rotor 2. It should be noted that the inflatable ring 18 helps accommodate non-linearity in the casing 7 since it allows the top of the casing 7 to float with respect to the longitudinal axis of the top drive 3 whilst being rotated to engage the pin of the casing 7 in the box of the casing string held in the spider in the rig floor. The low torque is transferred from the rotor 2 of the top drive through the piston and cylinders 15, through the housing 13 and via the inflatable ring 18 to the circulating tool 30 and hence to the stand of casing 7 via the gripping elements 34. The threaded pin of the stand of casing 7 is now partially made up with the threaded box of the casing string. The pipe handling arm 12 may now be removed from the casing 7 and swung into an inoperative position. The three piston and cylinders 43 of the clamping device are now activated evenly which moves the top of the stand of casing 7 and the circulating tool 30 into exact alignment with the top drive. The top drive may now be used to complete make-up by rotating the stand of casing typically up to 95,000 Nm (70,000 lb/ft) of torque. The high torque is transferred from the top drive 3 through piston and cylinders 15 through the housing 13, the rigid cylinder 40 and the clamping device 39 and hence to the stand of casing 7.

The spider may be used to hold the casing string 7 against rotation while this operation is carried out.

The elevator B may now be swung around the top of the casing 7. Circulation may now take place. Any pressure build up in the casing 7 would force the inflatable sealing ring 36 out and into engagement with the casing wall due to pressure build up through the feed passage 38. Circulating fluid may be pumped in to the casing string through mud pipe 19, central bore 20 and central passage 32.

The spider may be released allowing the elevator 8 to take the weight of the casing string. The elevator 8 may lower the casing string into the wellbore. During lowering the top drive 3 may continue to rotate the apparatus 1 and hence rotate the casing string at up to 95,000 Nm (70,000 lbs/ft) of torque, if required.

The apparatus 1 may be removed by deactivating the piston and cylinders 43 of the clamping device 39, the gripping elements 34 of the circulating tool 30, deflating the inflatable sealing ring 36 and lifting the apparatus 1 by raising the top drive 3.

A reverse sequence may be used to disconnect stands or single pieces of casing from a casing string.

It is envisaged that various modifications or variations may be made to the above described embodiment. In particular, the inflatable ring 18 may contain pneumatic fluid and be sealed. Alternatively, the inflatable ring 18 may be provided with a pneumatic supply line for controlling the pressure of the pneumatic fluid therein, for example for lowering the pressure when aligning the casing. The inflatable ring 18 may contain hydraulic fluid and be provided with a waste gate or a supply line for controlling the quantity of hydraulic fluid therein. A combination of both hydraulic and pneumatic fluids may be used preferably using hydraulic fluid in the inflatable ring and pneumatic bellows.

The inflatable ring may be a vehicle tyre.

It is envisaged that in certain embodiments the apparatus 1 may not be directly linked to the top drive 3. In particular, a motor, advantageously a hydraulic motor, may be inserted between the top drive 3 and the apparatus 1 for providing accurate speed of rotation and control for making up the casing.

It is envisaged that the apparatus 1 could be used for rotating the casing while lowering the casing. Reciprocation of the casing may also be provided simultaneously by raising and lowering the elevator.

It is envisaged that the casing string may be provided with a drilling bit as its lower end. The apparatus 1 may be used, with the clamping device 39 actuated, to rotate the casing and hence the drill bit, for drilling a wellbore.

It is conceivable that the clamping device 39 could be dispensed with and the entire torque from the top drive transmitted through the inflatable ring 18, particularly if highly pressurized with hydraulic fluid at the time it is desired to transmit high torque.

It is also envisaged that any suitable mechanism and method of actuation could be used for external clamping. For example, the mechanism could comprise cam surfaces with rough material thereon. The method of actuation could be mechanical, electrical, pneumatic, hydraulic or chemical. A design from a power tong may be suitable for this purpose.

While the foregoing is directed to embodiments of the present invention, other and further embodiments of the invention may be devised without departing from the basic scope thereof, and the scope thereof is determined by the claims that follow.

What is claimed is:

1. A method of connecting a first casing to a second casing using a top drive, comprising:

coupling a gripping apparatus to the top drive, the gripping apparatus having a radially movable gripping element adapted to engage the first casing and a seal for sealing between the gripping apparatus and an inner diameter of the casing;

actuating the gripping element to engage the first casing;

actuating the top drive to rotate the gripping apparatus and the first casing relative to the second casing thereby connecting the first casing to the second casing;

pumping a fluid through the gripping apparatus into the casing; and actuating the seal with a fluid pressure inside the casing.

2. The method of claim 1, wherein engaging the first casing comprises moving the gripping element radially into engagement with the first casing.

3. The method of claim 1, wherein the gripping element engages an interior surface of the first casing.

4. The method of claim 1, wherein the gripping element engages an exterior surface of the first casing.

5. The method of claim 4, wherein the gripping element forcibly grips an exterior surface of the first casing.

6. The method of claim 1, further comprising aligning the first casing to the second casing by moving the gripping apparatus in a substantially horizontal plane relative to the top drive.

7. The method of claim 1, further comprising rotating the first casing and the second casing to form a borehole.

8. The method of claim 1, wherein the gripping apparatus comprises a circulating tool.

9. The method of claim 1, wherein the gripping apparatus is adapted to engage an exterior surface of the first casing.

10. The method of claim 9, further comprising a second gripping apparatus adapted to engage an interior surface of the first casing.

11. The method of claim 10, wherein the second gripping apparatus forcibly grips an interior surface of the first casing.

12. The method of claim 1, further comprising lifting the connected first casing and second casing with the top drive.

13. The method of claim 12, wherein actuating the top drive rotates the gripping apparatus and the gripping element and wherein the gripping element transfers the rotation to the first casing.

14. The method of claim 1 wherein actuating the gripping element comprises supplying a hydraulic fluid to actuate the gripping element.

15. The method of claim 1, comprising supplying a fluid pressure to move the gripping element.

16. The method of claim 1, wherein the movable gripping element comprises a plurality of movable gripping elements.

17. A method of connecting a first casing to a second casing using a top drive, comprising:

coupling a gripping apparatus to the top drive, the gripping apparatus having a radially movable gripping element adapted to engage the first casing, and further including a seal for sealing between the gripping apparatus and an inner diameter of the first casing, the seal having a recess that opens to an area beneath the seal;

actuating the gripping element to engage the first casing;

actuating the top drive to rotate the gripping apparatus and the first casing relative to the second casing thereby connecting the first casing to the second casing; and pumping a fluid through the gripping apparatus into the first casing and thereby increasing a fluid pressure in the area beneath the seal so that a surface of the seal seals against a wall of the first casing through an action of the fluid pressure from an interior of the first casing into the recess.

18. The method of claim 17, wherein engaging the first casing comprises moving the gripping element radially into engagement with the first casing.

19. The method of claim 17, further comprising lowering the top drive to lower the first casing.

20. The method of claim 19, further comprising lowering the second casing.

21. The method of claim 20, further comprising rotating the first casing and the second casing.

22. The method of claim 21, further comprising forming a borehole.

23. The method of claim 17, wherein the radially movable gripping element comprises a plurality of radially movable gripping elements.

24. The method of claim 17, wherein the gripping element engages an interior surface of the first casing.

25. The method of claim 24, wherein the gripping element forcibly grips an interior surface of the first casing.

26. The method of claim 17, wherein the gripping element engages an exterior surface of the first casing.

27. The method of claim 26, wherein the gripping element forcibly grips and exterior surface of the first casing.

28. The method of claim 17, wherein the gripping apparatus comprises a circulating tool.

29. The method of claim 17, further comprising coupling an elevator to the top drive.

30. The method of claim 29, further comprising supporting the first casing with the elevator.

31. The method of claim 17, wherein the gripping apparatus further comprises a second radially movable gripping element.

32. The method of claim 31, wherein the gripping element is adapted to engage an interior surface of the first casing and the second gripping element is adapted to engage an exterior surface of the first casing.

33. The method of claim 17, wherein the area beneath the seal is an annular area defined by an outer diameter of at least a portion of the gripping apparatus and the inner diameter of the first casing.

34. An apparatus for connecting a first casing to a second casing using a top drive, comprising a body including at least a portion connected thereto having an outer diameter greater than an inner diameter of the first casing wherein the portion may be lowered onto the top of the first casing;

a motive fluid supply operatively connected to the body;

at least one movable gripping element operatively connected to the body and movable to engage or disengage the first casing in response to a fluid pressure change from the motive fluid supply; and a seal connected to the body for sealing between the apparatus and an inner diameter of the first casing, the seal having a recess that opens to an area beneath the seal so that pumping a fluid through the apparatus results in increased fluid pressure in the area beneath the seal and thereby seals an exterior sealing surface of the seal against the inner diameter of the first casing at a location axially proximate at least a portion of the recess.

35. The apparatus of claim 34, wherein the radially movable gripping element comprises a plurality of radially movable gripping elements.

36. The apparatus of claim 35, wherein the gripping elements are configured to engage the inner diameter of the first casing.

37. The apparatus of claim 35, wherein the gripping elements are configured to engage an outer diameter of the first casing.

38. The apparatus of claim 37, wherein the gripping elements are movable to forcibly grip an outer diameter of the first casing.

39. The apparatus of claim 34, wherein the apparatus comprises a circulating tool.

40. The apparatus of claim 34, wherein the apparatus comprises an elevator.

41. The apparatus of claim 34 further comprising a second radially movable gripping element.

42. The apparatus of claim 34, wherein the area beneath the seal is an annular area defined by an outer diameter of at least a portion of the apparatus and the inner diameter of the first casing.

43. The apparatus of claim 42, further comprising a motive fluid supply operatively connected thereto and configured to supply motive fluid for moving the gripping element.

44. An apparatus for connecting a first casing to a second casing using a top drive, comprising:

a top drive; and a gripping apparatus operatively coupled to the top drive, the gripping apparatus comprising:

at least one radially movable gripping element operatively coupled to at least one fluid driven piston and movable therewith to engage or disengage the first casing; and a seal for sealing between the gripping apparatus and an inner diameter of the first casing, the seal having a recess that opens to an area beneath the seal so that pumping a fluid through the gripping apparatus results in increased fluid pressure in the area beneath the seal and thereby seals an exterior sealing surface of the seal against the inner diameter of the casing at a location axially proximate at least a portion of the recess.

45. The apparatus of claim 44, wherein the gripping element comprises a plurality of gripping elements.

46. The apparatus of claim 44, wherein the gripping element is movable toward an axis of the first casing to a casing gripping position.

47. An apparatus for connecting a first casing to a second casing using a top drive, comprising:

a plurality of movable gripping elements to engage and disengage the first casing and movable in response to fluid pressure from a motive fluid supply operatively connected thereto;

a cylindrical body having a central passage there through; and a seal for sealing between the apparatus and an inner diameter of the first casing, the seal having a recess isolated from the central passage, the recess and the central passage each opening to an interior of the first casing below the apparatus.

48. The apparatus of claim 44, wherein the gripping element is movable away from an axis of the first casing to a casing gripping position.

49. The apparatus of claim 47, wherein the gripping elements are movable in response to an increase in fluid pressure.

50. The apparatus of claim 47, wherein the gripping elements are movable in response to a decrease in fluid pressure.

51. The apparatus of claim 47, wherein the seal is energized by a pressure within the interior of the first casing.

52. A method of connecting a first casing to a second casing using a top drive, comprising:

coupling a gripping apparatus to the top drive, the gripping apparatus having a radially movable gripping element adapted to engage the first casing and a seal for sealing between the gripping apparatus and an inner diameter of the casing;

actuating the gripping element to engage the first casing wherein actuating the gripping element comprises supplying a hydraulic fluid to actuate the gripping element;

actuating the top drive to rotate the gripping apparatus and the first casing relative to the second casing thereby connecting the first casing to the second casing wherein the gripping element transfers the rotation to the first casing;

pumping a fluid through the gripping apparatus into the casing; and actuating the seal with a fluid pressure inside the casing and below the gripping element, the seal having a recess isolated from direct communication with the central passage, the recess and the central passage each opening to an interior of the casing below the gripping apparatus.

53. A method of connecting a first casing to a second casing using a top drive, comprising:

coupling a gripping apparatus to the top drive, the gripping apparatus having a movable gripping element adapted to engage the first casing and a seal for sealing between the gripping apparatus and a wall of the casing;

actuating the gripping element to forcibly grip the first casing wherein actuating the gripping element comprises changing a motive fluid pressure to actuate the gripping element;

actuating the top drive to rotate the gripping apparatus and the first casing relative to the second casing thereby connecting the first casing to the second casing wherein the gripping element transfers a rotation force to the first casing;

pumping a fluid through the gripping apparatus into the casing; and actuating the seal with a fluid pressure inside the casing and below the gripping element, the seal having a recess isolated from direct communication with the central passage, the recess and the central passage each opening to an interior of the casing below the gripping apparatus.

54. The method of claim 53, wherein the gripping element comprises a plurality of gripping elements.

55. The method of claim 53, wherein the movable gripping element is movable toward and away from an axis of the first casing.

56. An apparatus for connecting a first casing to a second casing using a top drive, comprising:

a body having a central passage there through;

at least one movable gripping element adapted to engage and disengage the first casing and movable in response to fluid pressure from a motive fluid supply operatively connected to the body; and a seal for sealing between the apparatus and an inner diameter of the first casing, the seal having a recess isolated from the central passage, the recess and the central passage each opening to an interior of the first casing below the apparatus wherein the seal is energized by a pressure within the interior of the first casing.

57. The apparatus of claim 56, wherein the gripping element is movable toward and away from an axis of the first casing.

58. The apparatus of claim 57, wherein the gripping element comprises a plurality of gripping elements.

* * * * *

US007213656C1

(12) INTER PARTES REEXAMINATION CERTIFICATE (573rd)

United States Patent

Pietras

(10) Number: US 7,213,656 C1

(45) Certificate Issued: Apr. 5, 2013

(54) APPARATUS AND METHOD FOR FACILITATING THE CONNECTION OF TUBULARS USING A TOP DRIVE

(75) Inventor: Bernd-Georg Pietras, Wedemark, DE (US)

(73) Assignee: Weatherford/Lamb, Inc., Houston, TX (US)

Reexamination Request:
No. 95/001,117, Nov. 18, 2008

Reexamination Certificate for:

| | |
|---|---|
| Patent No.: | **7,213,656** |
| Issued: | **May 8, 2007** |
| Appl. No.: | **10/831,864** |
| Filed: | **Apr. 26, 2004** |

Related U.S. Application Data

(63) Continuation of application No. 09/868,790, filed as application No. PCT/GB99/03951 on Nov. 29, 1999, now Pat. No. 6,725,938.

(30) Foreign Application Priority Data

Dec. 24, 1998 (GB) ..... 9828673

(51) Int. Cl.
*E21B 19/16* (2006.01)

(52) U.S. Cl.
USPC ..... 166/380; 166/85.1

(58) Field of Classification Search ..... None
See application file for complete search history.

(56) References Cited

To view the complete listing of prior art documents cited during the proceeding for Reexamination Control Number 95/001,117, please refer to the USPTO's public Patent Application Information Retrieval (PAIR) system under the Display References tab.

*Primary Examiner* — Peter C. English

(57) ABSTRACT

An apparatus and method for facilitating the connection of tubulars using a top drive and is, more particularly but not exclusively, intended for facilitating the connection of a section or stand of casing to a string of casing.

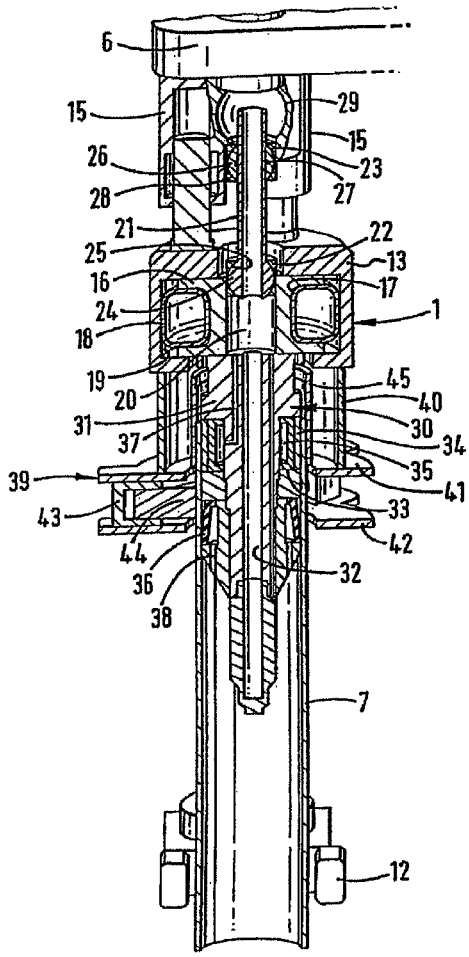

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 4, 6, 7, 19-22, 26 and 34-58 are cancelled.

Claims 1-3, 5, 8, 9, 13-18, 23-25, 27 and 32 are determined to be patentable as amended.

Claims 10-12, 28-31 and 33, dependent on an amended claim, are determined to be patentable.

New claims 59-71 are added and determined to be patentable.

1. A method of connecting a first casing to a second casing using a top drive, comprising:

coupling a *first* gripping apparatus to the top drive, the *first* gripping apparatus having a *first* radially movable gripping element adapted to engage *an exterior surface of* the first casing and a seal for sealing between the gripping apparatus and an inner diameter of the casing;

actuating the *first radially movable* gripping element to engage *the exterior surface of* the first casing;

actuating the top drive to rotate the *first* gripping apparatus and the first casing relative to the second casing thereby connecting the first casing to the second casing;

pumping a fluid through the gripping apparatus into the casing; [and]

actuating the seal with a fluid pressure inside the casing*; and*

*aligning the first casing to the second casing by moving the first gripping apparatus in a substantially horizontal plane relative to the top drive.*

2. The method of claim 1, wherein engaging the first casing comprises moving the *first radially movable* gripping element radially into engagement with the first casing.

3. The method of claim 1, wherein the *first gripping apparatus further comprises a second radially movable* gripping element [engages] *adapted to engage* an interior surface of the first casing.

5. The method of claim [4] *1*, wherein the *first radially movable* gripping element forcibly grips an exterior surface of the first casing.

8. The method of claim 1, wherein the *first* gripping apparatus comprises a circulating tool.

9. The method of claim 1, wherein the *first* gripping apparatus is adapted to engage an exterior surface of the first casing.

13. The method of claim 12, wherein actuating the top drive rotates the *first* gripping apparatus and the *first radially movable* gripping element and wherein the *first radially movable* gripping element transfers the rotation to the first casing.

14. The method of claim 1 wherein actuating the *first radially movable* gripping element comprises supplying a hydraulic fluid to actuate the *first radially movable* gripping element.

15. The method of claim 1, comprising supplying a fluid pressure to move the *first radially movable* gripping element.

16. The method of claim 1, wherein the *first radially* movable gripping element comprises a plurality of movable gripping elements.

17. A method of connecting a first casing to a second casing using a top drive, comprising:

coupling a gripping apparatus to the top drive, the gripping apparatus having a *first* radially movable gripping element adapted to engage *an exterior surface of* the first casing, and further including a seal for sealing between the gripping apparatus and an inner diameter of the first casing, the seal having a recess that opens to an area beneath the seal;

actuating the gripping element to engage *the exterior surface of* the first casing;

actuating the top drive to rotate the gripping apparatus and the first casing relative to the second casing thereby connecting the first casing to the second casing; [and]

pumping a fluid through the gripping apparatus into the first casing and thereby increasing a fluid pressure in the area beneath the seal so that a surface of the seal seals against a wall of the first casing through an action of the fluid pressure from an interior of the first casing into the recess*;*

*lowering the top drive to lower the first casing;*

*lowering the second casing; and*

*forming a borehole by rotating the first casing and the second casing.*

18. The method of claim 17, wherein engaging the first casing comprises moving the *first radially movable* gripping element radially into engagement with the first casing.

23. The method of claim 17, wherein *first* radially movable gripping element comprises a plurality of radially movable gripping elements.

24. The method of claim 17, wherein [the] *a second radially movable* gripping element engages an interior surface of the first casing.

25. The method of claim 24, wherein the *second radially movable* gripping element forcibly grips an interior surface of the first casing.

27. The method of claim [26] *17*, wherein the *first radially movable* gripping element forcibly grips [and] *an* exterior surface of the first casing.

32. The method of claim 31, wherein the *second radially movable* gripping element is adapted to engage an interior surface of the first casing [and the second gripping element is adapted to engage an exterior surface of the first casing].

*59. A method of connecting a first casing to a second casing using a top drive, comprising:*

*coupling a first gripping apparatus to the top drive, the first gripping apparatus having a first radially movable gripping element adapted to engage an exterior surface of the first casing and a seal for sealing between the gripping apparatus and an inner diameter of the casing;*

*actuating the first radially movable gripping element to engage the exterior surface of the first casing;*

*actuating the top drive to rotate the first gripping apparatus and the first casing relative to the second casing thereby connecting the first casing to the second casing;*

*pumping a fluid through the gripping apparatus into the casing;*

*actuating the seal with a fluid pressure inside the casing; and*

*rotating the first casing and the second casing to form a borehole.*

*60. The method of claim 59, wherein engaging the first casing comprises moving the first radially movable gripping element radially into engagement with the first casing.*

*61. The method of claim 59, wherein the first gripping apparatus further comprises a second radially movable gripping element adapted to engage an interior surface of the first casing.*

*62. The method of claim 59, wherein the first radially movable gripping element forcibly grips an exterior surface of the first casing.*

*63. The method of claim 59, wherein the first gripping apparatus comprises a circulating tool.*

*64. The method of claim 59, wherein the first gripping apparatus is adapted to engage an exterior surface of the first casing.*

*65. The method of claim 64, further comprising a second gripping apparatus adapted to engage an interior surface of the first casing.*

*66. The method of claim 65, wherein the second gripping apparatus forcibly grips an interior surface of the first casing.*

*67. The method of claim 59, further comprising lifting the connected first casing and second casing with the top drive.*

*68. The method of claim 67, wherein actuating the top drive rotates the first gripping apparatus and the first radially movable gripping element and wherein the first radially movable gripping element transfers the rotation to the first casing.*

*69. The method of claim 59 wherein actuating the first radially movable gripping element comprises supplying a hydraulic fluid to actuate the first radially movable gripping element.*

*70. The method of claim 59, comprising supplying a fluid pressure to move the first radially movable gripping element.*

*71. The method of claim 59, wherein the first radially movable gripping element comprises a plurality of movable gripping elements.*

* * * * *